US006536873B1

(12) United States Patent
Lee et al.

(10) Patent No.: US 6,536,873 B1
(45) Date of Patent: Mar. 25, 2003

(54) DROP-ON-DEMAND INK JET PRINTER CAPABLE OF DIRECTIONAL CONTROL OF INK DROP EJECTION AND METHOD OF ASSEMBLING THE PRINTER

(75) Inventors: Yung-Rai R. Lee, Pittsford, NY (US); John A. Lebens, Rochester, NY (US); Gilbert A. Hawkins, Mendon, NY (US); Ravi Sharma, Fairport, NY (US); Walter S. Stevens, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 164 days.

(21) Appl. No.: 09/607,840

(22) Filed: Jun. 30, 2000

(51) Int. Cl.[7] ..... B41J 2/04
(52) U.S. Cl. ..... 347/54
(58) Field of Search ..... 347/54, 68, 69, 347/70, 71, 72, 50; 399/261; 361/700; 29/890.1; 310/328–330

(56) References Cited

U.S. PATENT DOCUMENTS

| | | | | |
|---|---|---|---|---|
| 1,941,001 A | | 12/1933 | Hansell | |
| 3,709,432 A | | 1/1973 | Robertson | |
| 3,878,519 A | | 4/1975 | Eaton | |
| 3,893,623 A | | 7/1975 | Toupin | |
| 3,946,398 A | | 3/1976 | Kyser et al. | |
| 4,275,290 A | | 6/1981 | Cielo et al. | |
| 4,283,730 A | | 8/1981 | Graf | |
| 4,286,274 A | | 8/1981 | Shell et al. | |
| 4,540,990 A | | 9/1985 | Crean | |
| 4,631,550 A | | 12/1986 | Piatt et al. | |
| 4,994,821 A | | 2/1991 | Fagerquist | |
| 5,850,241 A | * | 12/1998 | Silverbrook | 347/54 |

FOREIGN PATENT DOCUMENTS

| | | |
|---|---|---|
| EP | 0 911 168 A2 | 4/1999 |
| GB | 2007162 | 5/1979 |
| GB | 2041831 A | 9/1980 |
| WO | WO 96/32281 A2 | 10/1996 |

OTHER PUBLICATIONS

US 08/954,317, filed Apr. 7, 2000, Chwalek et al, entitled Continuous Ink Jet Printer with Asymmetric Heating Drop Deflection, (Docket 76,553).

US 09/586,099, filed Jun. 2, 2000, Hawkins et al, entitled Permanent Alteration of a Print– head for Correction of Misdirection of Emitted ink Drops, (Docket 79,491).

US 09/470,638, filed Dec. 22, 1999, Delametter et al, entitled Deflection Enhancement for Continuous Ink Jet Printers, (Docket 79,799).

US 09/475,639, filed Dec. 30, 1999, Cabal et al, entitled Continuous Ink Jet printer with Notch Deflector (Docket 79,800).

* cited by examiner

*Primary Examiner*—Raquel Yvette Gordon
(74) *Attorney, Agent, or Firm*—Walter S. Stevens; Norman Rushefsky

(57) ABSTRACT

Drop-on-demand ink jet printer capable of directional control of ink drop ejection and method of assembling the method. The method comprises a print head body having an ink ejection orifice adapted to poise an ink meniscus thereat about a center axis passing through the orifice. A deflector is coupled to the print head body and is adapted to be in communication with the poised meniscus for lowering surface tension of a region of the poised meniscus. The poised meniscus deflects away from the region of lower surface tension and away from the center axis to define a deflected meniscus, whereby an ink drop separated from the deflected meniscus travels at an angle with respect to the center axis, so that the ink drop can strike a receiver at any one of a plurality of predetermined locations on a print line.

46 Claims, 15 Drawing Sheets

DROP-ON-DEMAND INK JET PRINTER CAPABLE OF DIRECTIONAL CONTROL OF INK DROP EJECTION AND METHOD OF ASSEMBLING THE PRINTER

FIELD OF THE INVENTION

This invention generally relates to ink jet printer apparatus and methods and more particularly relates to a drop-on-demand ink jet printer capable of directional control of ink drop ejection, and method of assembling the printer.

BACKGROUND OF THE INVENTION

An ink jet printer produces images on a receiver by ejecting ink droplets onto the receiver in an imagewise fashion. The advantages of non-impact, low-noise, low energy use, and low cost operation in addition to the capability of the printer to print on plain paper are largely responsible for the wide acceptance of ink jet printers in the marketplace.

However, it is desirable to control the angle at which the droplet travels to the recording medium. For example, if any one of ink ejection nozzles is inoperable, such as due to clogging or manufacturing defect, it would be desirable to redirect droplets from operable nozzles to print at locations that would otherwise be printed by the inoperable nozzle. In addition, if each nozzle can print dots at a plurality of locations on the receiver, then fewer nozzles are needed, thereby reducing print head manufacturing costs.

In addition, it is desirable to control velocity at which the ink droplets strike the recording medium. Control of velocity in turn controls printing speed.

Ink jet printers may be either DOD (Drop-Qn-Demand) or "continuous" ink jet printers. In this regard, in the case of DOD ink jet printers, at every orifice a pressurization actuator is used to produce the ink jet droplet. Either one of two types of actuators may be used. These two types of actuators are heat actuators and piezoelectric actuators.

A DOD ink jet printer having a heat actuator is disclosed in Great Britain Pat. No. 2,007,162, which issued to Endo et al. in 1979. In such a printer, a heater placed at a convenient location heats the ink and a quantity of the ink will phase change into a gaseous bubble and raise the internal ink pressure sufficiently for an ink droplet to be expelled to the recording medium. However, the Endo et al. patent does not disclose a technique for directional control of the ink droplet ejected from the printer. More specifically, the Endo et al. patent does not disclose a technique to redirect the ink droplets to a plurality of printing locations on the recording medium. In addition, the Endo et al. patent does not appear to disclose a technique for controlling velocity of the ink droplet.

A DOD ink jet printer combining a pressurized reservoir and a heat-assisted drop ejection mechanism is disclosed in U.S. Pat. No. 4,275,290, which issued to Cielo et al. According to the Cielo et al. patent, a liquid ink printing system supplies ink to a reservoir at a predetermined pressure and the ink is retained in orifices by surface tension until the surface tension is reduced by heat from an electrically energized resistive heater, which causes ink to issue from the orifice and to thereby contact a paper receiver. However, the Cielo et al. patent does not disclose a technique for directional control of the ink drop ejected from the printer. More specifically, the Endo et al. patent does not disclose a technique to redirect the ink droplets to a plurality of printing locations on the recording medium. In addition, the Cielo et al. patent does not appear to disclose a technique for controlling velocity of the ink droplet.

A DOD ink jet printer having a piezoelectric actuator is disclosed in U.S. Pat. No. 3,946,398, which issued to Kyser et al. in 1970. In this type of printer, a piezoelectric material is used, which piezoelectric material possesses piezoelectric properties such that an applied electric field produces a mechanical stress in the material to decrease ink channel volume and thereby eject an ink droplet. However, the Kyser et al. patent does not disclose a technique for directional control of the ink drop ejected from the printer. More specifically, the Kyser et al. patent does not disclose a technique to redirect the ink droplets to a plurality of printing locations on the recording medium. In addition, the Kyser et al. patent does not appear to disclose a technique for controlling velocity of the ink droplet.

A "continuous" ink jet printer is disclosed in U.S. Pat. No. 4,631,550 issued Dec. 23, 1986 to Michael J. Piatt, et al. and assigned to the assignee of the present invention. Such a continuous ink jet printer utilizes electrostatic charging tunnels that are placed close to where ink droplets are being ejected in the form of a stream. Selected ones of the droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the receiver. However, the Piatt et al. patent does not disclose a technique for directional control of the ink drop ejected from a DOD printer. More specifically, the Kyser et al. patent does not disclose a technique to redirect the ink droplets ejected by a DOD printer to a plurality of printing locations on the recording medium. In addition, the Piatt et al. patent does not appear to disclose a technique for controlling velocity of the ink droplet.

However, attempts have been made to provide ink jet printers having ink ejection nozzles capable of placing ink droplets at different locations on a scan line. For example, a continuous ink jet printer having means for correcting droplet trajectories to account for variations in droplet "throw distance" to improve droplet placement accuracy is disclosed in U.S. Pat. No. 4,540,990 issued Sep. 10, 1995 to Peter A. Crean. According to the Crean patent, distance sensing sensors periodically produce signals representative of the actual throw distance of the droplets and compare the signals indicative of the actual throw distance to a signal representative of the distance from the nozzles to a predetermined printing plane. The comparison signals are sent to a printer controller which adjusts the droplet trajectories in response thereto to correct the placement errors that would be caused by variations in the throw distance produced, for example, by wrinkles in the recording medium or dimensional tolerance variations in the recording medium transport system. Deflection of the droplets is obtained by varying deflection voltage of deflection electrodes that charge the droplets. However, the Crean patent does not disclose a technique for variable directional control of the ink drop ejected from a DOD ink jet printer because the Crean device is a continuous ink jet printer rather than a DOD ink jet printer. Also, the Crean patent does not disclose a technique other than use of a deflection voltage for directional control of the ink drop. Moreover, the Crean patent does not appear to disclose a technique for controlling velocity of the ink droplet.

Although each of the devices mentioned hereinabove is useful for its intended purpose, none of the DOD ink jet printing devices provides directional control of ink droplet ejection and none of the continuous ink jet printing devices uses a technique other than deflection voltage for directional control of the ink droplet. Moreover, none of the devices mentioned hereinabove controls velocity of the ink droplet.

Therefore, there has been a long-felt need to provide a drop-on-demand ink jet printer capable of directional control of ink drop ejection and method of assembling the printer.

SUMMARY OF THE INVENTION

An object of the present invention is to provide a drop-on-demand ink jet printer capable of directional control of ink drop ejection, so that any one of a plurality of ink ejection nozzles belonging to the printer prints at a plurality of locations on a recording medium.

With the above object in view, the present invention resides in a drop-on-demand ink jet printer capable of directional control of ink drop ejection, comprising a print head body having an ink ejection orifice adapted to poise an ink meniscus thereat about a center axis passing through the orifice; and a deflector coupled to the print head body and adapted to be in communication with the poised meniscus for lowering surface tension of a region of the poised meniscus, so that the poised meniscus deflects away from the region of lower surface tension and away from the center axis to define a deflected meniscus, whereby an ink drop separated from the deflected meniscus travels at an angle with respect to the center axis.

According to an exemplary embodiment of the present invention, the printer comprises a print head body having a plurality of elongate ink channels therein, each channel terminating in a generally circular ink ejection orifice. Each orifice is adapted to poise an ink meniscus thereat symmetrically about a center axis normal to the orifice. A plurality of arcuate-shaped heater segments are connected to the print head body and are symmetrically arranged in an annular ring surrounding each orifice. The heater segments are adapted to be in heat transfer communication with the poised meniscus and are capable of being energized for lowering surface tension of a predetermined side region of any one of the poised menisci. When a selected one of the heater segments is energized, a region of lower surface tension is created, such that the poised meniscus laterally deflects away from the side region of lower surface tension and away from the center axis to define a deflected meniscus. In this manner, an ink drop that is separated from the deflected meniscus travels along a trajectory at a predetermined angle with respect to the center axis. The angle is variable depending on the extent to which the heater segments are energized.

A pressurizer is connected to the print head body and is in communication with each of the channels for pressurizing the channels to form the poised menisci and thereafter to separate the ink drop from the deflected meniscus. In this regard, the pressurizer may be a plurality of deflectable piezoelectric transducers in communication with respective ones of the plurality of channels, the piezoelectric transducers being adapted to deflect into the channels while electrically stimulated for reducing volume of the channels so that the channels pressurize. Alternatively, the pressurizer may be a plurality of displaceable flexible membranes in communication with respective ones of the plurality of channels, the flexible membranes adapted to flex into the channels while pressurized for reducing volume of the channels so that the channels pressurize. On the other hand, the pressurizer may be a plurality of movable pistons in communication with respective ones of the plurality of channels, the pistons adapted to move into the channels for reducing volume of the channels so that the channels pressurize. Moreover, the pressurizer is controlled such that the pressurizer separates the ink drop at a predetermined velocity.

A feature of the present invention is the provision of a plurality of arcuate-shaped heater segments to laterally deflect the poised meniscus, so that an ink drop separated from the deflected meniscus travels along a trajectory at a predetermined variable angle.

Another feature of the present invention is the provision of a pressurizer in communication with each of the channels for pressurizing the channels to form the poised menisci and thereafter to separate the ink drop from the deflected meniscus, the pressurizer also being capable of controlling velocity of the ink drop.

An advantage of the present invention is that, if any one of the ejection orifices is inoperable, such as due to clogging or manufacturing defect, ink drops are redirected from the operable orifice to print at locations that would otherwise be printed by the inoperable orifice.

Another advantage of the present invention is that use thereof reduces print head manufacturing costs.

Yet another advantage of the present invention is that printing speed is variable depending on the particular needs of the print job.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
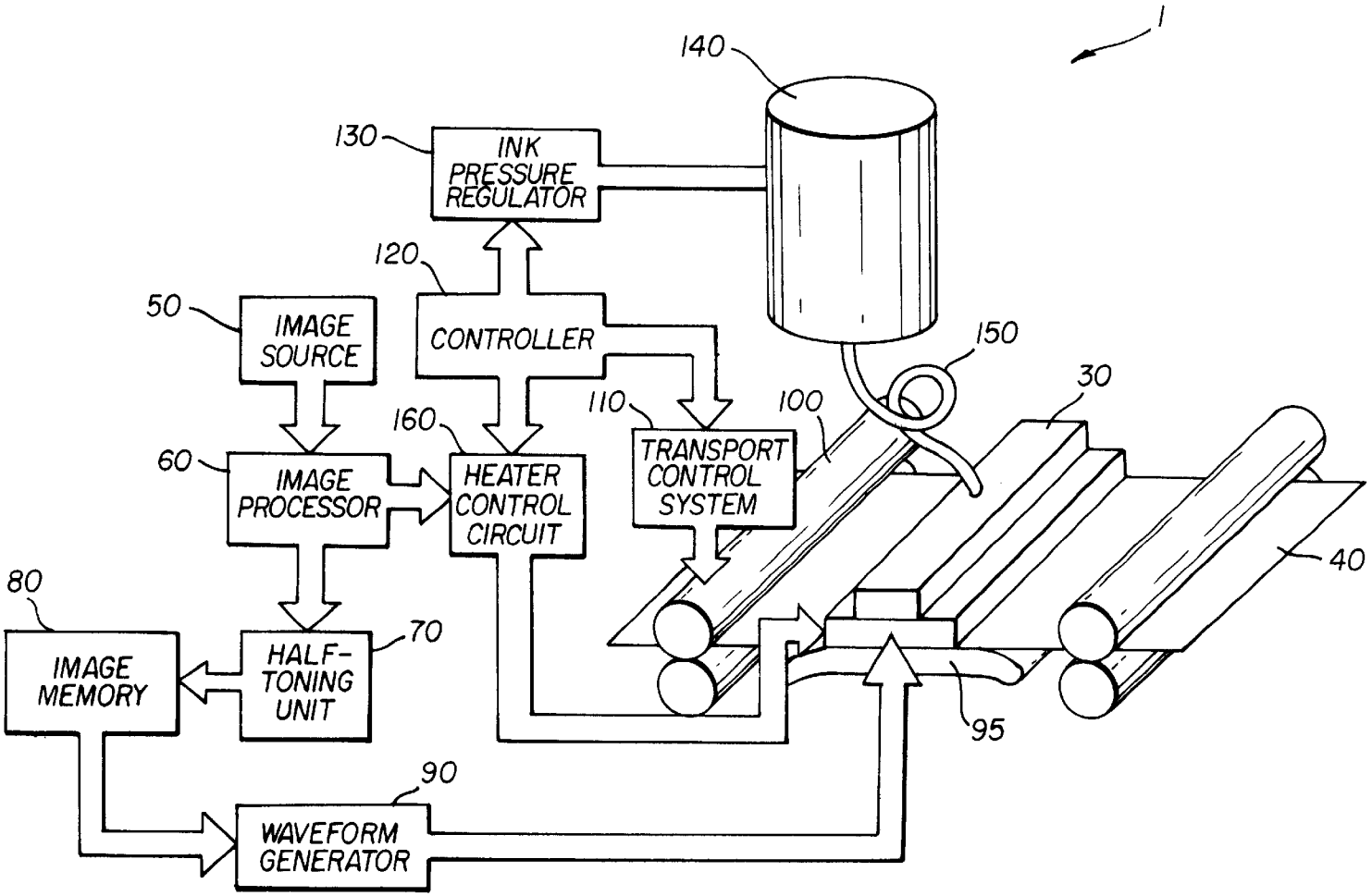
FIG. 1 is a view in perspective of a drop-on-demand ink jet printer according to the present invention, the printer having a print head.
Figure 2:
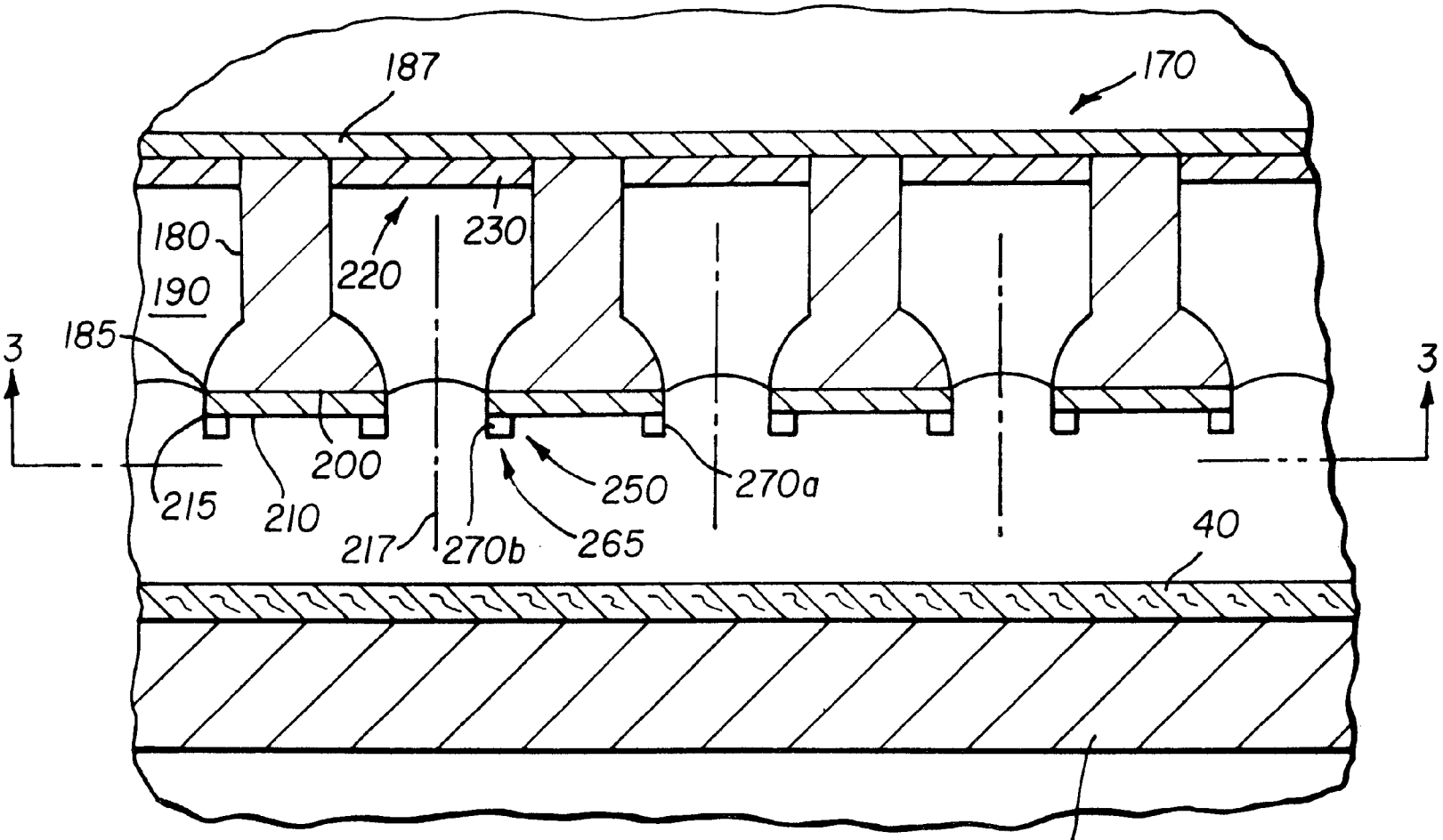
FIG. 2 is a fragmentation view in vertical section of a print head body associated with the print head, the print head body having a plurality of ink channels therein terminating in ink ejection orifices.
Figure 6:
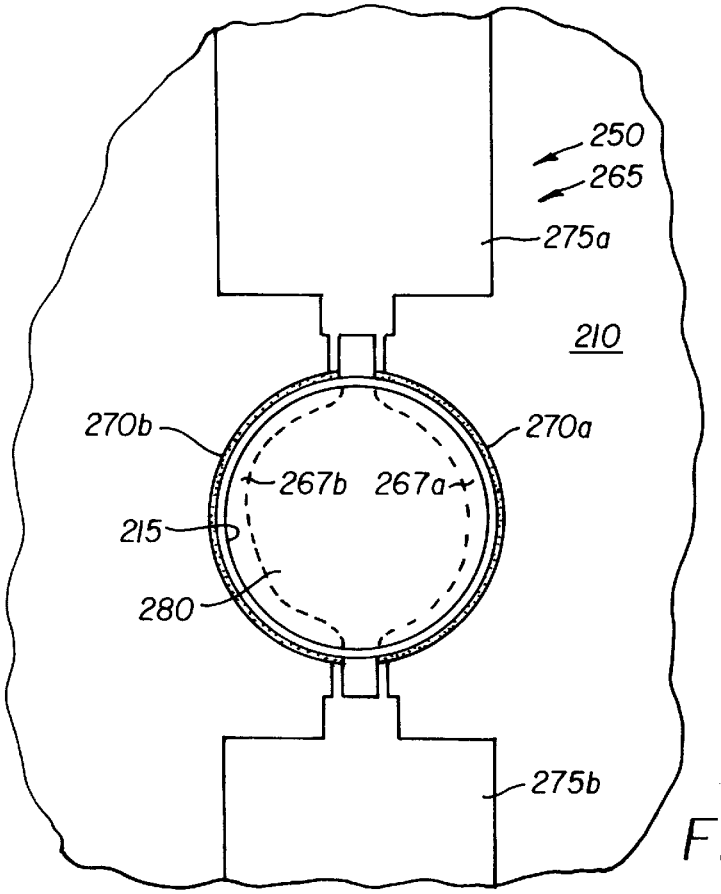
FIG. 6 is a fragmentation view of the heater assembly, this view also showing side regions where the poised meniscus is heated by the heater assembly.
Figure 7:
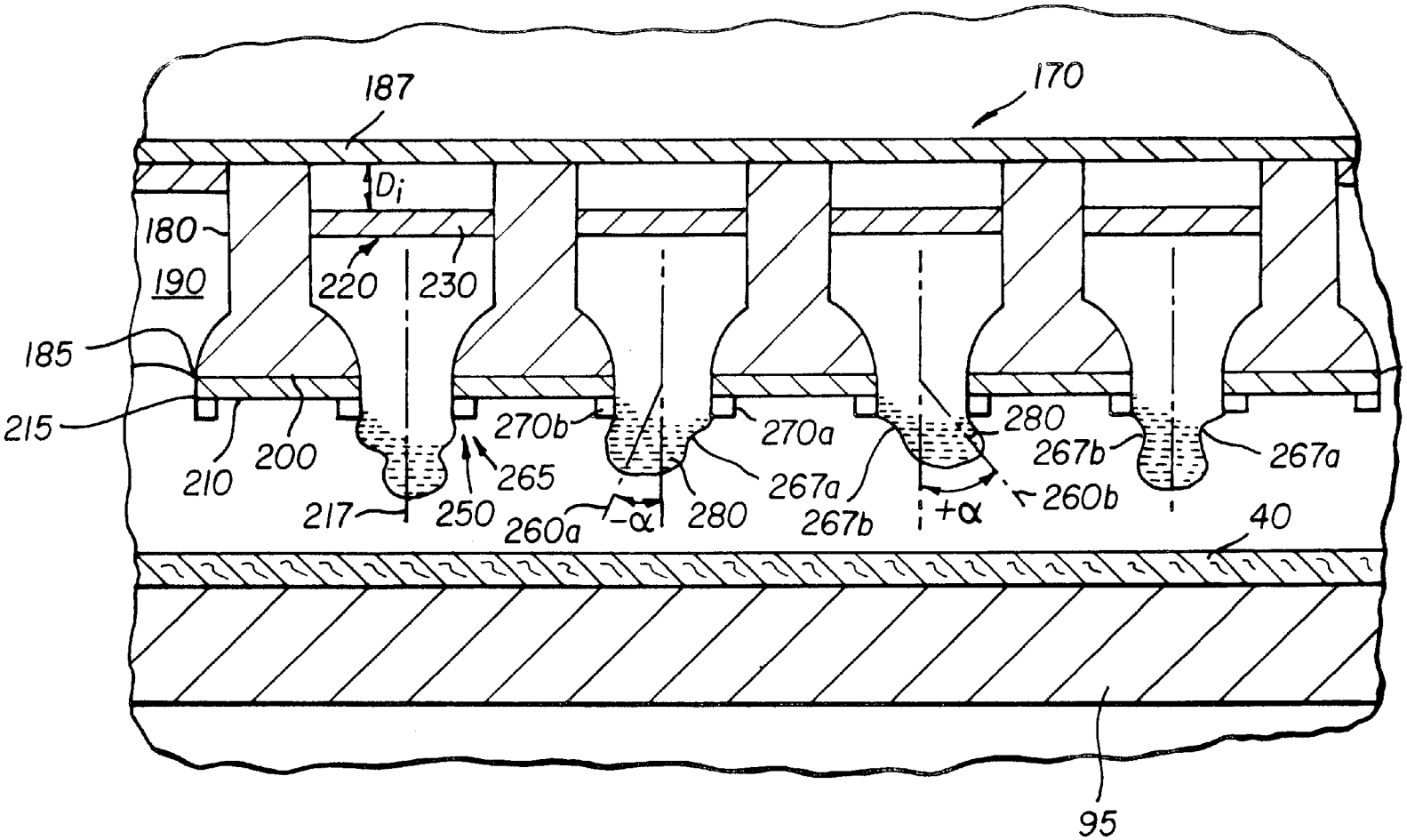
FIG. 7 is a fragmentation view in vertical section of the print head body, this view also showing formation of a deflected and an undeflected meniscus acted upon by both the pressurizer and the heater assembly, this view further showing undeflected meniscus when acted upon only by the pressurizer.

Therefore, referring to FIGS. 1 and 2, there is shown the subject matter of the present invention, which is a DOD (Drop-On-Demand) ink jet printer, generally referred to as 10. Printer 10 is capable of directionally controlling ejection of an ink droplet 20 (see FIG. 6) from a print head 30 toward a receiver 40, as described more fully hereinbelow. Receiver 40 may be a reflective-type (e.g., paper) or transmissive-type (e.g., transparency) receiver.

As shown in FIG. 1, imaging apparatus 10 comprises an image source 50, which may be raster image data from a scanner or computer, or outline image data in the form of a PDL (Page Description Language) or other form of digital image representation. This image data is transmitted to an image processor 60 connected to image source 50. Image processor 60 converts the image data to a pixel-mapped page image. Image processor 60 may be a raster image processor in the case of PDL image data to be converted, or a pixel image processor in the case of raster image data to be converted. In any case, image processor 60 transmits continuous tone data to a digital halftoning unit 70 connected to image processor 50. Halftoning unit 70 halftones the continuous tone data produced by image processor 60 and produces halftoned bitmap image data that is stored in an image memory 80, which may be a full-page memory or a band memory depending on the configuration of imaging apparatus 10. A waveform generator 90 connected to image memory 80 reads data from image memory 80 and applies electrical stimuli to print head 30, for reasons disclosed hereinbelow.

Referring again to FIG. 1, receiver 40 is moved relative to print head 30 and across a supporting platen 95 by means of a plurality of transport rollers 100, which are electronically controlled by a transport control system 110. Transport control system 110 in turn is controlled by a suitable controller 120. It may be appreciated that different mechanical configurations for receiver transport control may be used. For example, in the case of pagewidth print heads, it is convenient to move receiver 40 past a stationary print head 30. On the other hand, in the case of scanning-type printing systems, it is more convenient to move print head 30 along one axis (i.e., a sub-scanning direction) and receiver 40 along an orthogonal axis (i.e., a main scanning direction), in relative raster motion.

Still referring to FIG. 1, controller 120 may be connected to an ink pressure regulator 130 for controlling regulator 130. Regulator 130, if present, is capable of regulating pressure in an ink reservoir 140. Ink reservoir 140 is connected, such as by means of a conduit 150, to print head 30 for supplying liquid ink to print head 30. In addition, controller 120 controls a heater control circuit 160 connected to print head 30 for reasons provided hereinbelow. Moreover, heater control circuit 160 itself is capable of accepting image data from image processor 60 for reasons provided hereinbelow.

Figure 3:
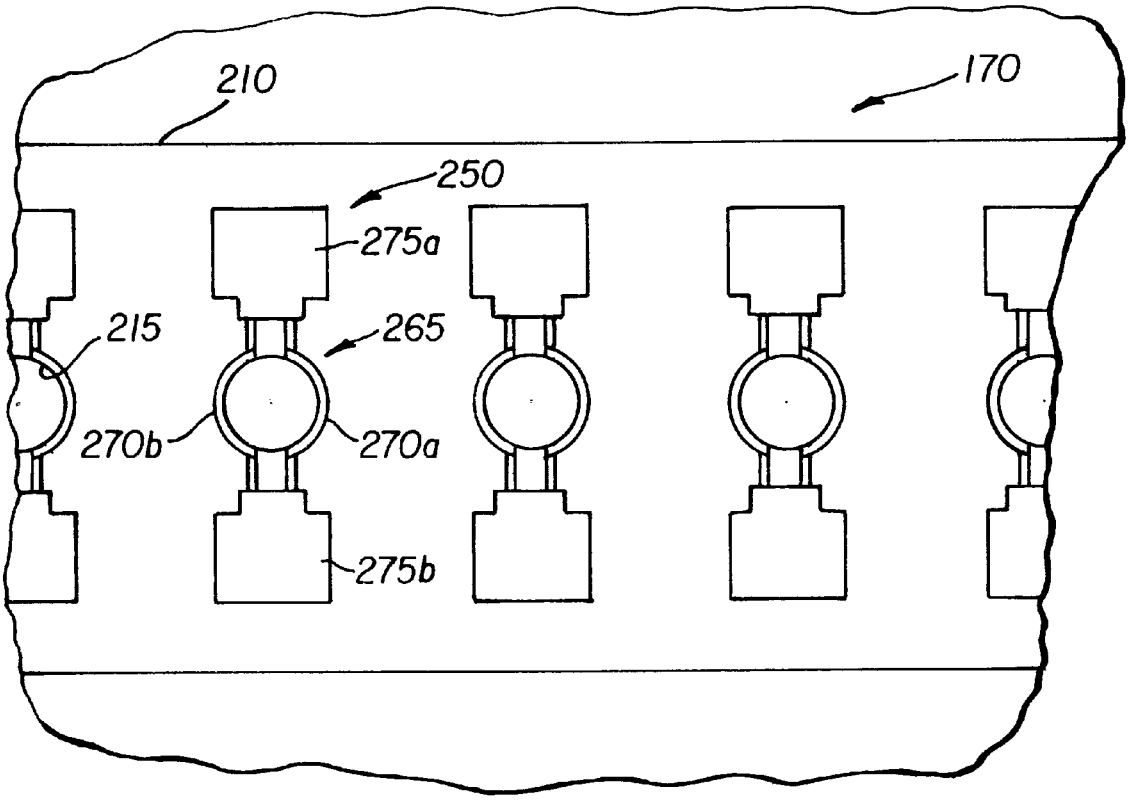
FIG. 3 is a fragmentation view taken along section line 3—3 of FIG. 2, showing the ejection orifices and a heater assembly associated with each orifice, each heater assembly having two heater segments.

Referring to FIGS. 1, 2, and 3, print head 30 comprises a print head body, generally referred to as 170. Print head body 170 has a plurality of elongate and parallel ink channels 180 cut therein, each channel defining a channel outlet 185 at one end thereof. Closing-off the other end of channels 180 is a backing plate 187 spanning all channels 180. Each of ink channels 180 is capable of accepting ink controllably supplied thereinto from reservoir 140, so as to define an ink body 190 in each channel 180. Print head body 170 also includes a surface 200 on which is affixed an orifice plate 210 having a plurality of generally circular orifices 215 formed therethrough and aligned with respective ones of ink channel outlets 185. Each of orifices 215 defines a center axis 217 normal to orifice 215.

Figure 4:
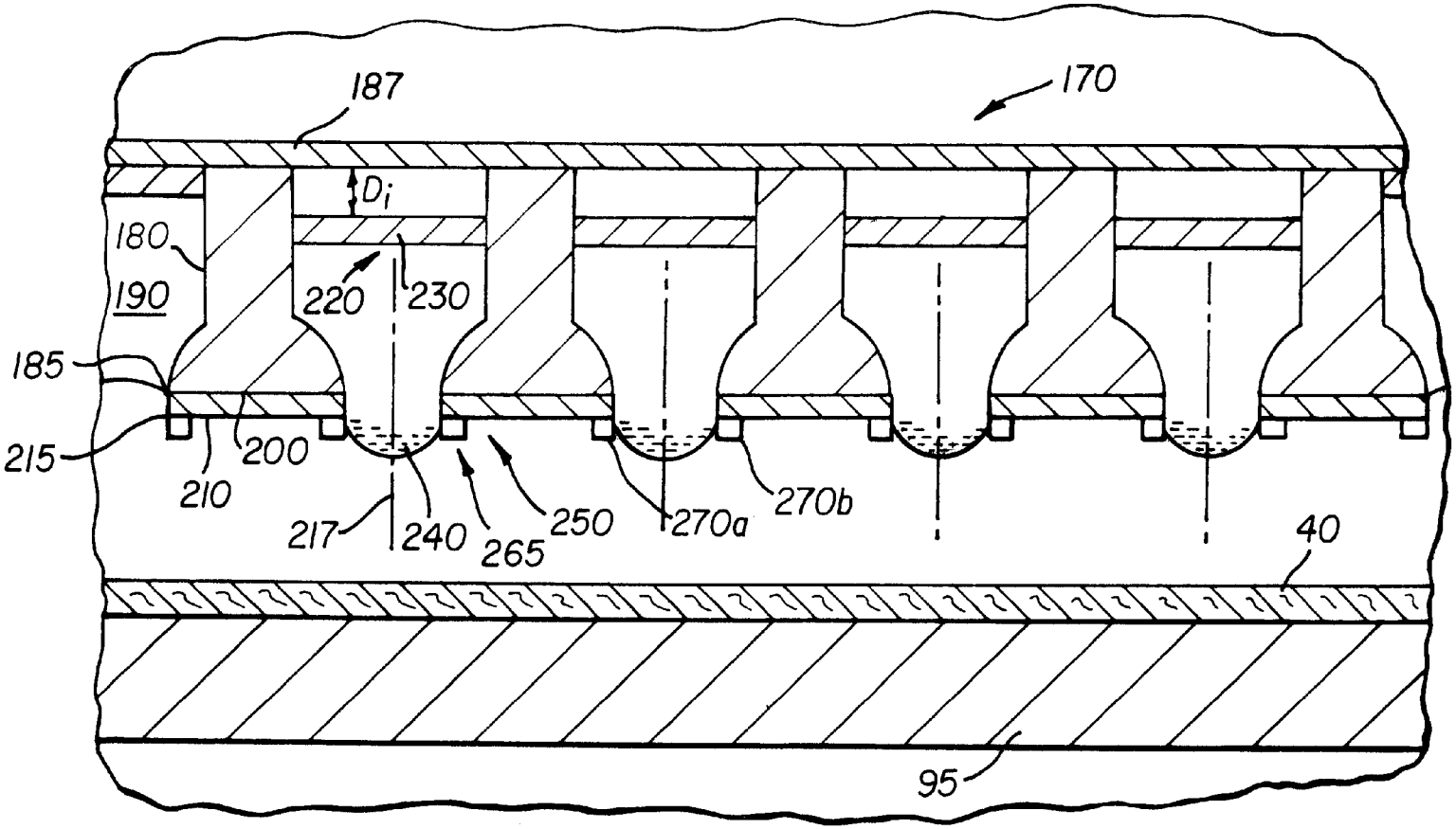
FIG. 4 is a fragmentation view in vertical section of the print head body and ink channels, this view also showing a displaceable piezoelectric transducer disposed in each channel for forming a poised meniscus at each orifice, selected ones of the piezoelectric transducers being deflected or displaced by a distance $D_i$.
Figure 5:
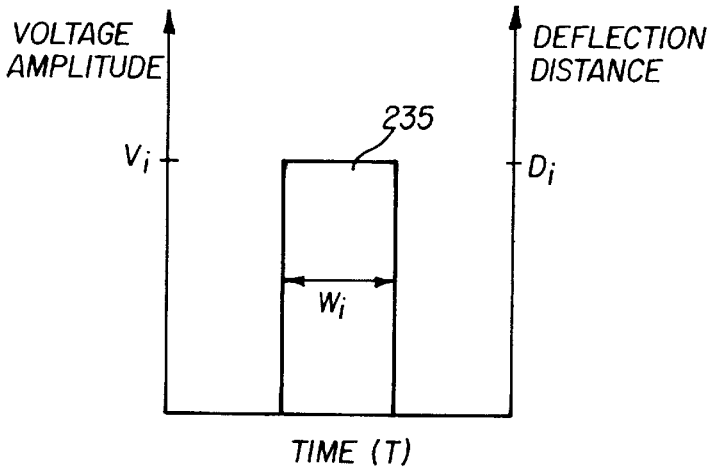
FIG. 5 is a graph illustrating voltage amplitude $V_i$ as a function of time T for electrical signals supplied to the heater assemblies and the resulting deflection distance $D_i$.

Referring to FIGS. 2, 3, and 4, in fluid communication with respective ones of ink bodies 190 are a plurality of ink drop separators, generally referred to as 220, for pressurizing ink bodies 190. In this regard, each ink drop separator 220 may be a deflectable piezoelectric transducer 230 in communication with respective ones of channels 180, the transducer 230 being adapted to deflect into channel 180 while being electrically stimulated. In this regard, piezoelectric transducer 230 may be formed of a naturally occurring material, such as quartz and tourmaline. Alternatively, piezoelectric transducer 230 may be formed of a man-made piezoelectric ceramic, such as lead zirconate titanate (PZT), barium titanate, lead titanate, or lead metaniobate.

Referring to FIGS. 1, 2, 3, 4 and 5, previously mentioned waveform generator 90 supplies an electrical pulse 235 to piezoelectric transducer 230 in order to electrically stimulate piezoelectric transducer 230. Piezoelectric transducer 230, when electrically stimulated, is deflected a distance "$D_i$" with respect to backing plate 187. In this regard, each pulse 235 has a pulse width "$W_i$" and a voltage amplitude "$V_i$" corresponding to deflection distance $D_i$. The integer "i" uniquely identifies the unique pulse 235 associated with a unique pulse width $W_i$, voltage amplitude $V_i$ and deflection distance $D_i$. Thus, for a particular pulse width $W_i$ and voltage amplitude $V_i$, there is provided a unique deflection distance $D_i$. In this manner, deflection distance $D_i$ is variable depending on values of pulse width $W_i$ and voltage amplitude $V_i$.

Figure 8:
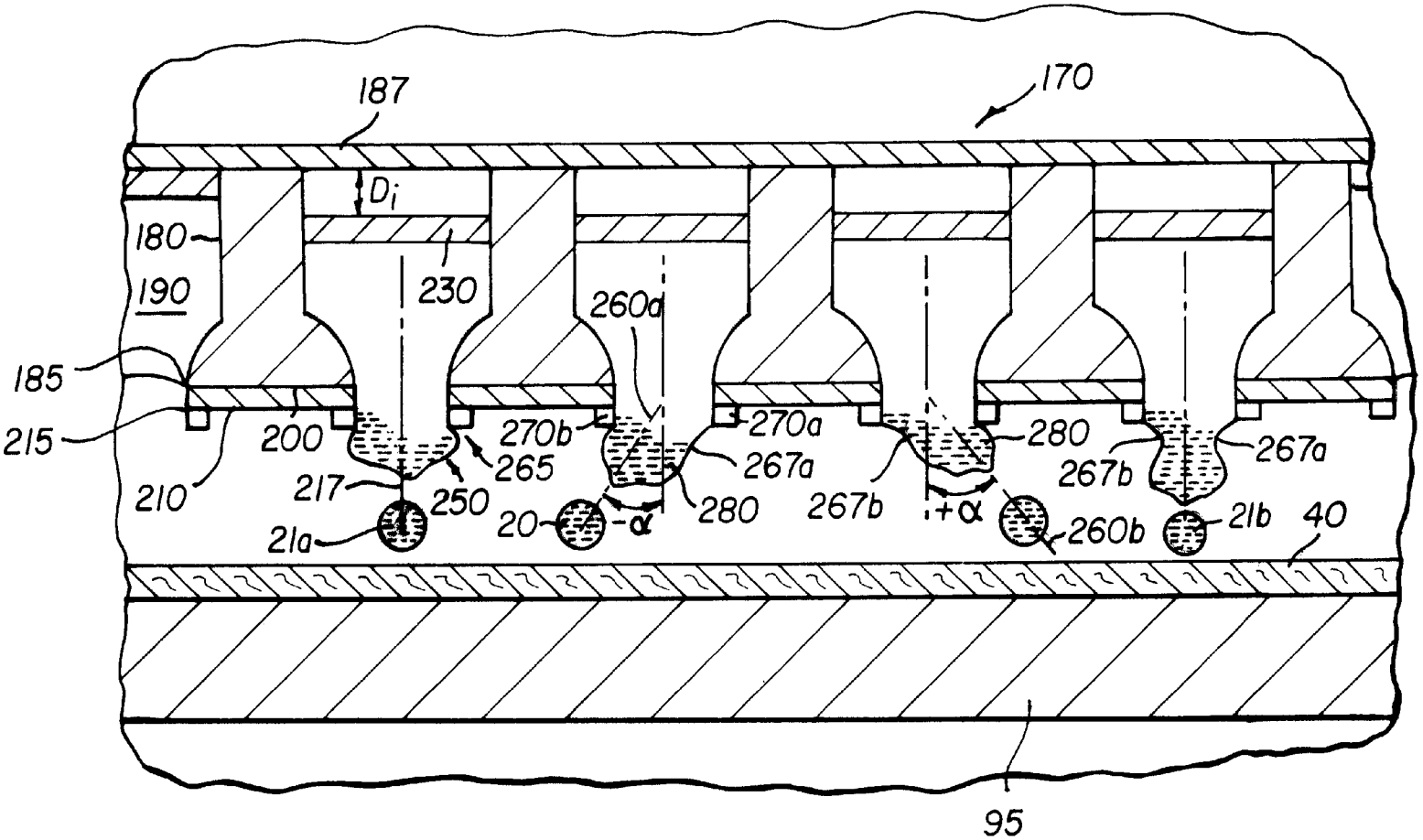
FIG. 8 is a fragmentation view in vertical section of the print head body, this view also showing formation of a deflected and an undeflected ink drop.

Referring to FIG. 4, as piezoelectric transducer 230 is displaced distance $D_i$, an outwardly extending meniscus at orifice 215 forms to define a poised meniscus 240 located symmetrically about center axis 217. Normally, force exerted by piezoelectric transducer 230, as it moves through distance $D_i$, is sufficient to cause droplet 21 a (see FIG. 8) to separate from poised meniscus 240 and travel along center axis 217 and strike receiver 40 to make an ink mark (not shown) on receiver 40. However, it has been observed that if any one of the orifices 215 is inoperable, such as due to clogging or manufacturing defect, the mark will not be printed on receiver 40 or printed at an undesirable location on receiver 40. Thus, it is desirable to redirect droplets from the operable orifice to print at the location that would otherwise be printed by the inoperable orifice. In addition, it has been observed that if each orifice 215 can print ink marks at a plurality of locations on receiver 40, then fewer orifices 215 and associated ink channels 180 are needed, thereby reducing manufacturing costs for print head 30.

Therefore, referring to FIGS. 2, 3, 6, 7 and 8, mounted on orifice plate 210 and adjacent to each orifice 215 is a deflector, generally referred to as 250, for deflecting ink drop 20 away from center axis 217, so that ink drop 20 travels along a deflected trajectory 260*a* or 260*b*. Trajectory 260*a* or 260*b* is oriented at a predetermined variable angle $-\alpha$ or $+\alpha$, respectively, with respect to center axis 215. Deflector 250 comprises a heater assembly 265 connected to print head body 170 and adapted to be in heat transfer communication with poised meniscus 240 for lowering surface tension of a side region 267*a* and 267*b* (dotted line in FIG. 6) of poised meniscus 240. To accomplish this result, heater assembly 265 itself preferably comprises a plurality of arcuate-shaped heater segments 270*a* and 270*b* symmetrically arranged in a generally annular ring surrounding orifice 215. Each heater segment 270*a* and 270*b* is connected to heater control circuit 160 by means of electrical contacts 275*a* and 275*b*. In this manner, heater control circuit 160 controllably and selectively supplies electrical current to either heater segment 270*a* or heater segment 270*b* for reasons provided hereinbelow. However, it should be appreciated that heater control circuit 160 is also capable of controllably supplying electrical current to heater segment 270*a* and heater segment 270*b* simultaneously for reasons provided hereinbelow.

Referring again to FIGS. 2, 3, 6, 7 and 8, when heater segment 270*a* is energized, surface tension of poised meniscus 240 will lower in side region 267*a* causing meniscus 240 to laterally deflect or lean away from side region 267*a*, so as to define a deflected meniscus 280. The deflected meniscus 280 is generally centered about deflected trajectory 260*a* at angle $-\alpha$ with respect to center axis 217. Alternatively, when heater segment 270*b* is energized, surface tension of poised meniscus 240 will lower in side region 267 causing meniscus 240 to laterally deflect or lean away from side region 267*b*, so as to define deflected meniscus 280. In this case, deflected meniscus 280 is generally centered about deflected trajectory 260*b* at angle $+\alpha$ with respect to center axis 217.

It may be appreciated that the values of angle $-\alpha$ and $+\alpha$ can vary depending on the amount of electric current supplied by heater control circuit 160 to heater segments 270*a*/*b*. However, it may also be appreciated that when no current is supplied to heater segments 270*a*/*b*, a droplet 21 a will travel along center axis 217 (see FIG. 8). Also, when the same amount of current is simultaneously supplied to both heater segments 270*a*/*b*, a droplet 21*b* will travel along center axis 217 (see FIG. 8). In addition, force exerted on ink body 190 bypiezoelectric transducer 230 is chosen such that the force causes droplets 20 and 21*a*/*b* to separate from deflected meniscus 280 or from undeflected poised meniscus 240, respectively.

Figure 9:
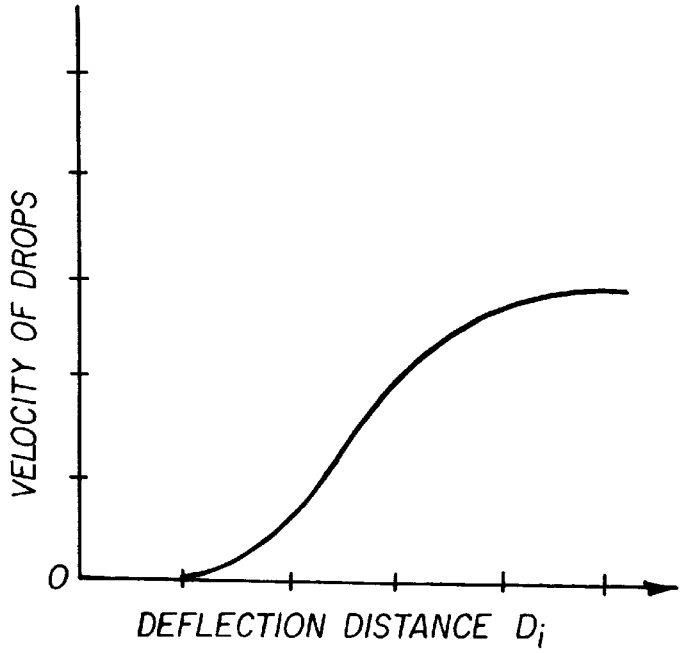
FIG. 9 is a graph illustrating ink drop velocity as a function of deflection distance $D_i$.
Figure 10:
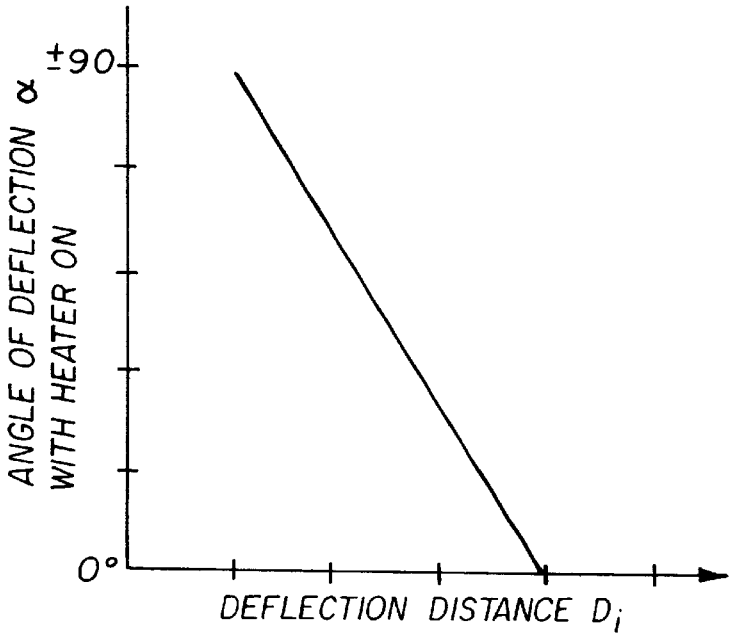
FIG. 10 is a graph illustrating absolute value of an angle of deflection $\pm\alpha$ as a function of deflection distance Di as a heater segment is energized.

Referring to FIGS. 9 and 10, there is illustrated, in graphical form, velocity of droplet 20 as a function of deflection distance $D_i$ and angle of deflection $\alpha$ as a function of deflection distance $D_i$, respectively. More specifically, FIG. 9 shows that velocity of droplet 20 as a function of deflection distance $D_i$ assumes an "S" shaped curve. FIG. 10 shows that absolute value of angle of deflection a as a function of deflection distance $D_i$, with heater segment 270*a* or 270*b* energized, varies linearly.

Figure 11:
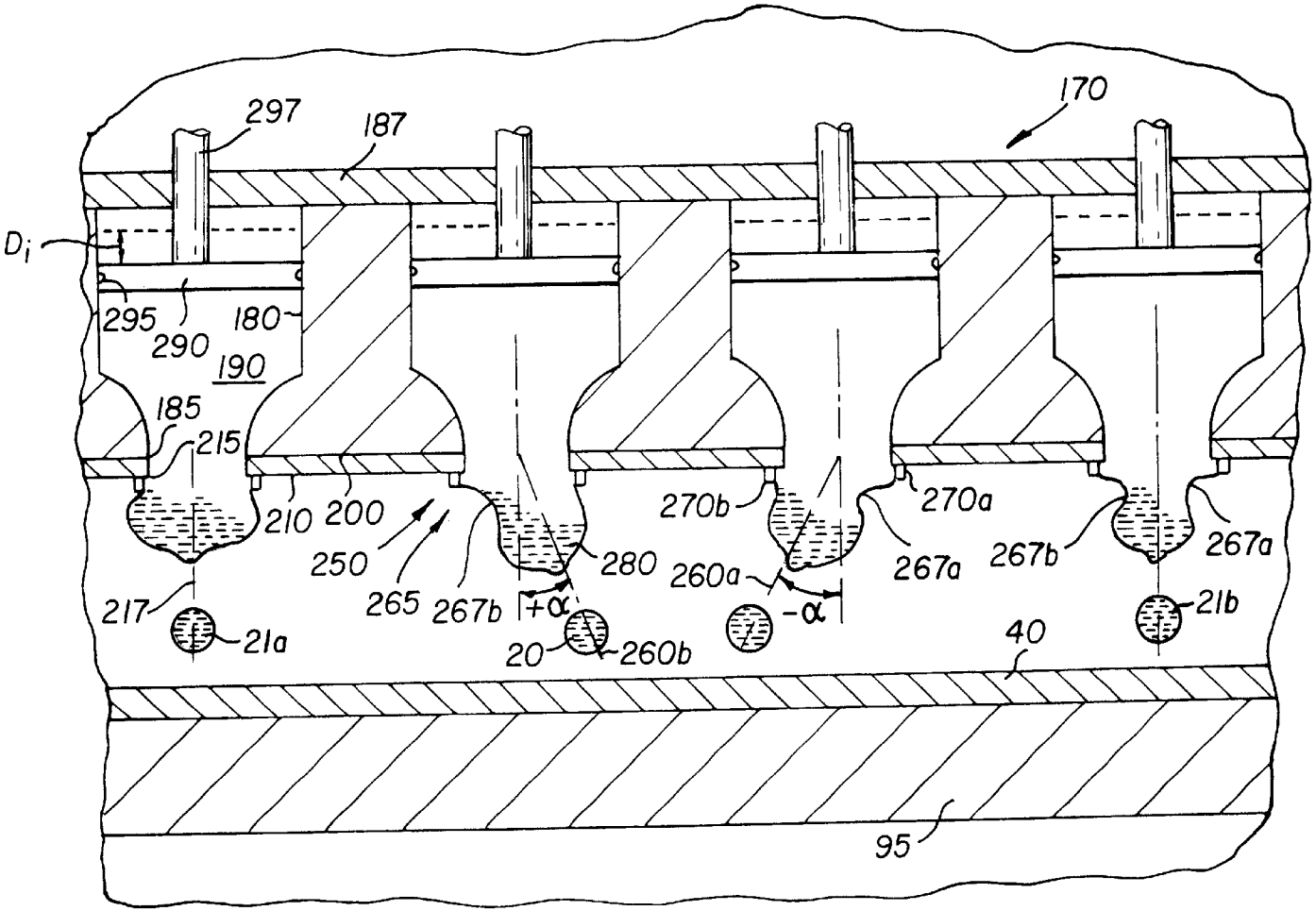
FIG. 11 is a fragmentation view in vertical section of a second embodiment of the printer, wherein a piston is disposed in each channel belonging to the print head body.

Turning now to FIG. 11, there is shown a second embodiment of the present invention, wherein piezoelectric transducer 230 is replaced with a piston 290 for pressurizing ink body 190. Piston 290 is slidable in ink channel 180 and may include an annular seal 295 surrounding a perimeter of piston 290. Seal 295 is capable of sealingly engaging the walls of ink channel 180, so that no ink leaks around the perimeter of piston 290 to otherwise compromise maintenance of pressure on ink body 190. Piston 290 also includes a piston rod 297 connected thereto and movable by means of a suitable motor (not shown) for sliding piston 290 in ink channel 180.

Figure 12:
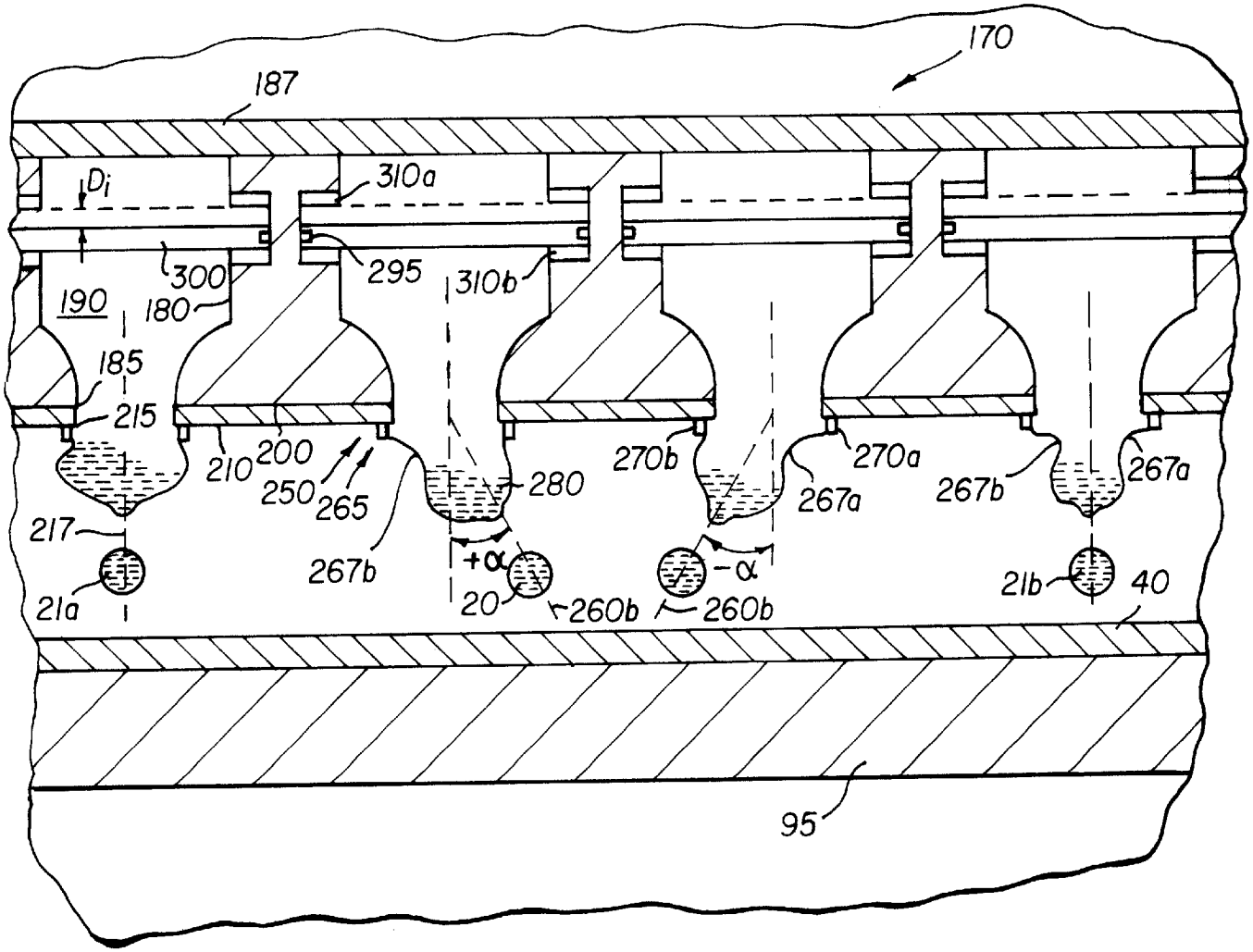
FIG. 12 is a fragmentation view in vertical section of a third embodiment of the printer, wherein a plate member is disposed in each channel belonging to the print head body.

Referring to FIG. 12, there is shown a third embodiment of the present invention, wherein piezoelectric transducer 230 is replaced by a metallic plate member 300 disposed between an upper electromagnet 310*a* and a lower electromagnet 310*b* to pressurize and depressurize ink body 190. Electromagnets 310*a*/*b* are capable of being alternatively energized. That is, when electromagnet 310*a* is energized, plate member 300 moves vertically upwardly, such that ink body 190 is depressurized so that no meniscus forms. Alternatively, when electromagnet 310*b* is energized, plate member 300 moves vertically downwardly, such that ink body 190 is pressurized so that poised meniscus 240 forms and ink droplet 20 (or 21*a*/*b*) is ejected.

Figure 13:
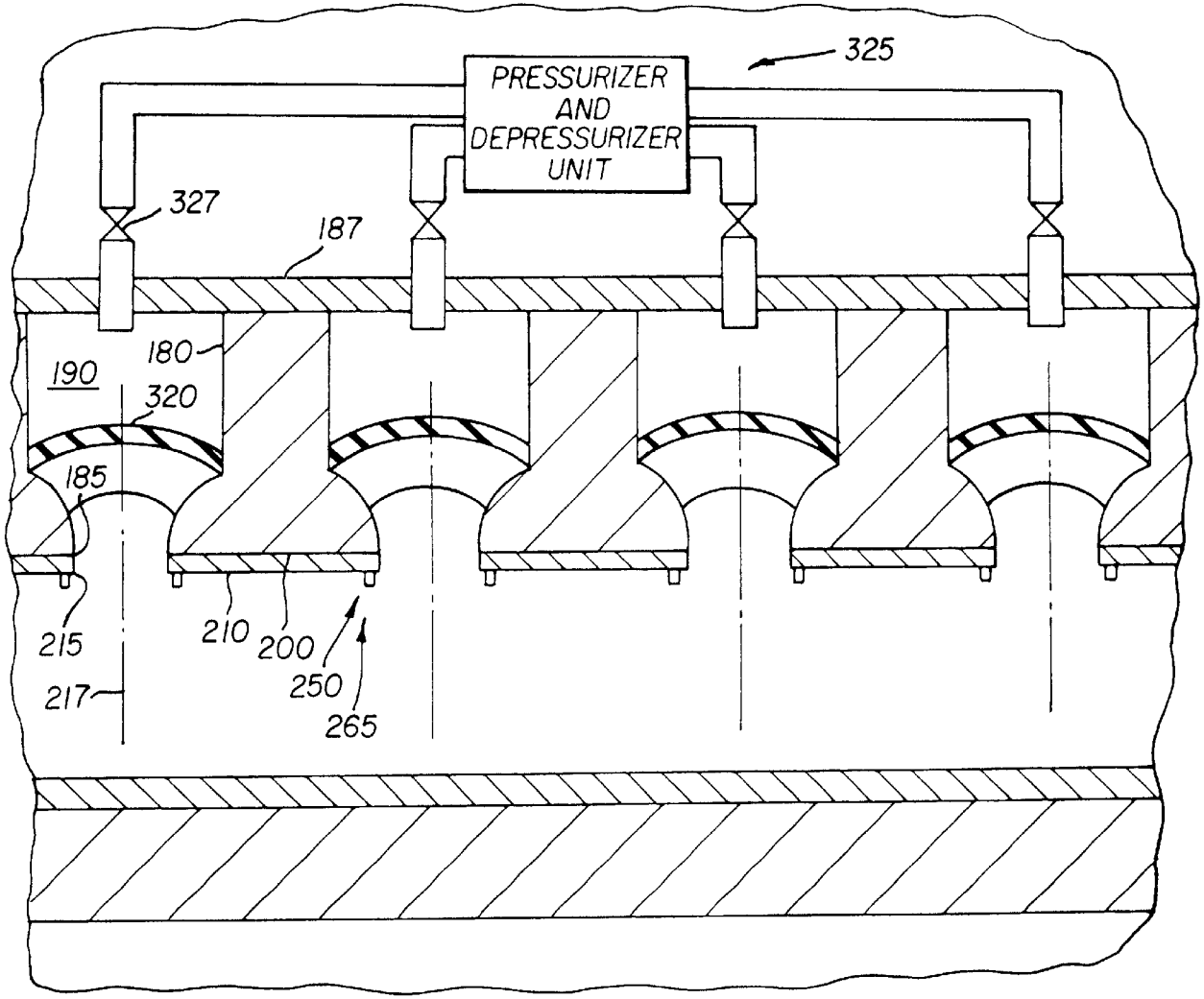
FIG. 13 is a fragmentation view in vertical section of a fourth embodiment of the printer, wherein an elastomeric member is disposed in each channel belonging to the print head body, the elastomeric member being in a state of depressurization.
Figure 14:
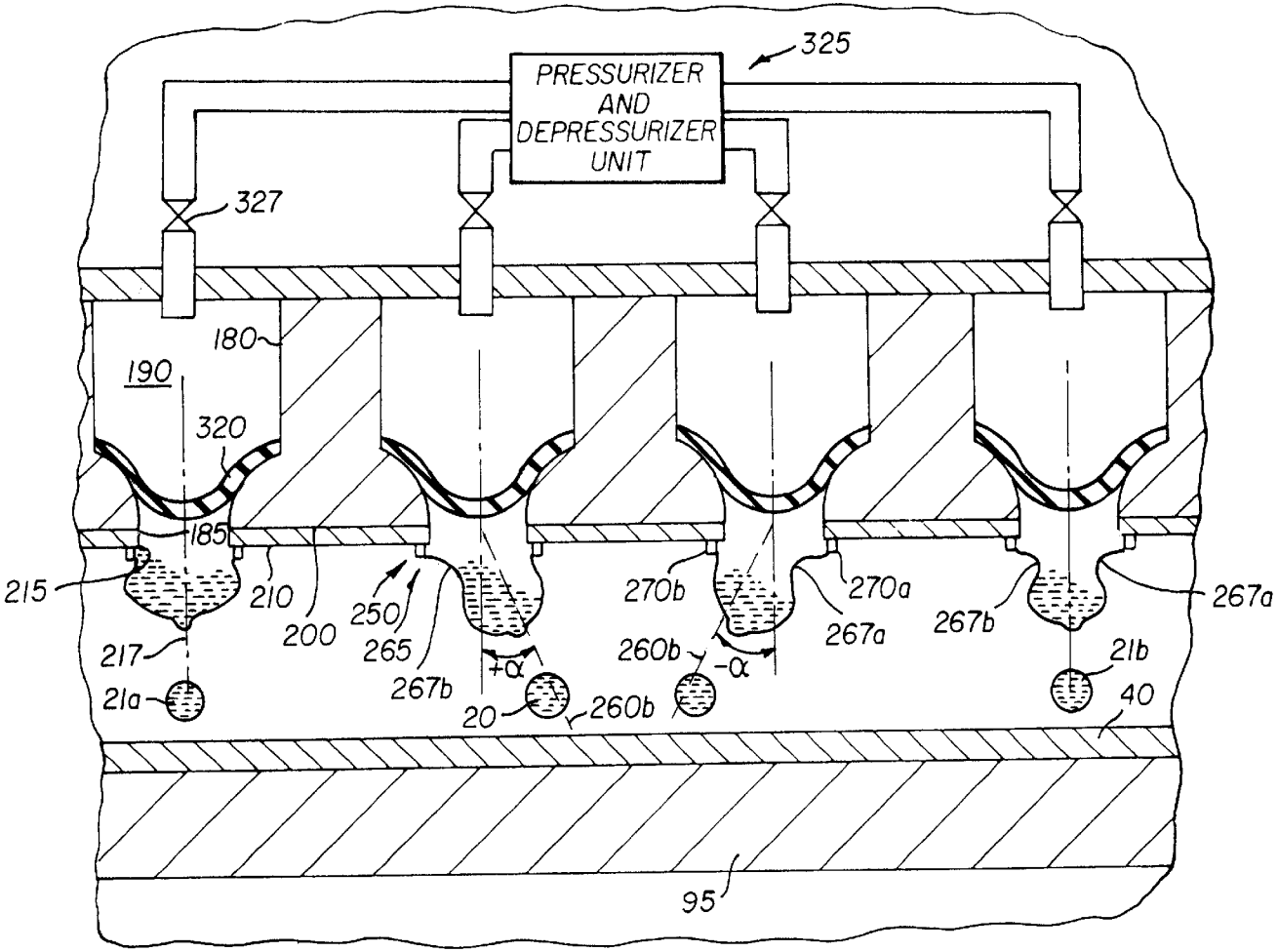
FIG. 14 is a fragmentation view in vertical section of the fourth embodiment of the printer, wherein the elastomeric member is shown in a state of pressurization.

Referring to FIGS. 13 and 14, there is shown a fourth embodiment of the present invention, wherein piezoelectric transducer 230 is replaced by a flexible elastomeric membrane 320 capable of being alternately pressurized for downward flexing within ink channel 180 to pressurize ink body 190 and depressurized for upward flexing within ink channel 180 to depressurizing ink body 190. Of course, when elastomeric membrane 320 flexes vertically upwardly, ink body 190 is depressurized so that no meniscus forms. Alternatively, when elastomeric membrane 320 flexes vertically downwardly, ink body 190 is pressurized so that poised meniscus 240 forms and ink droplet 20 (or 21*a*/*b*) is ejected. Elastomeric membrane 320 is caused to flex upwardly and downwardly by means of a suitable pressurizer and depressurizer unit, generally referred to as 325, in communication with each elastomeric membrane 320, such as by means of individual control valves 327. The pressurizing medium may be a gas, such as air, or a liquid, such as water.

Figure 15:
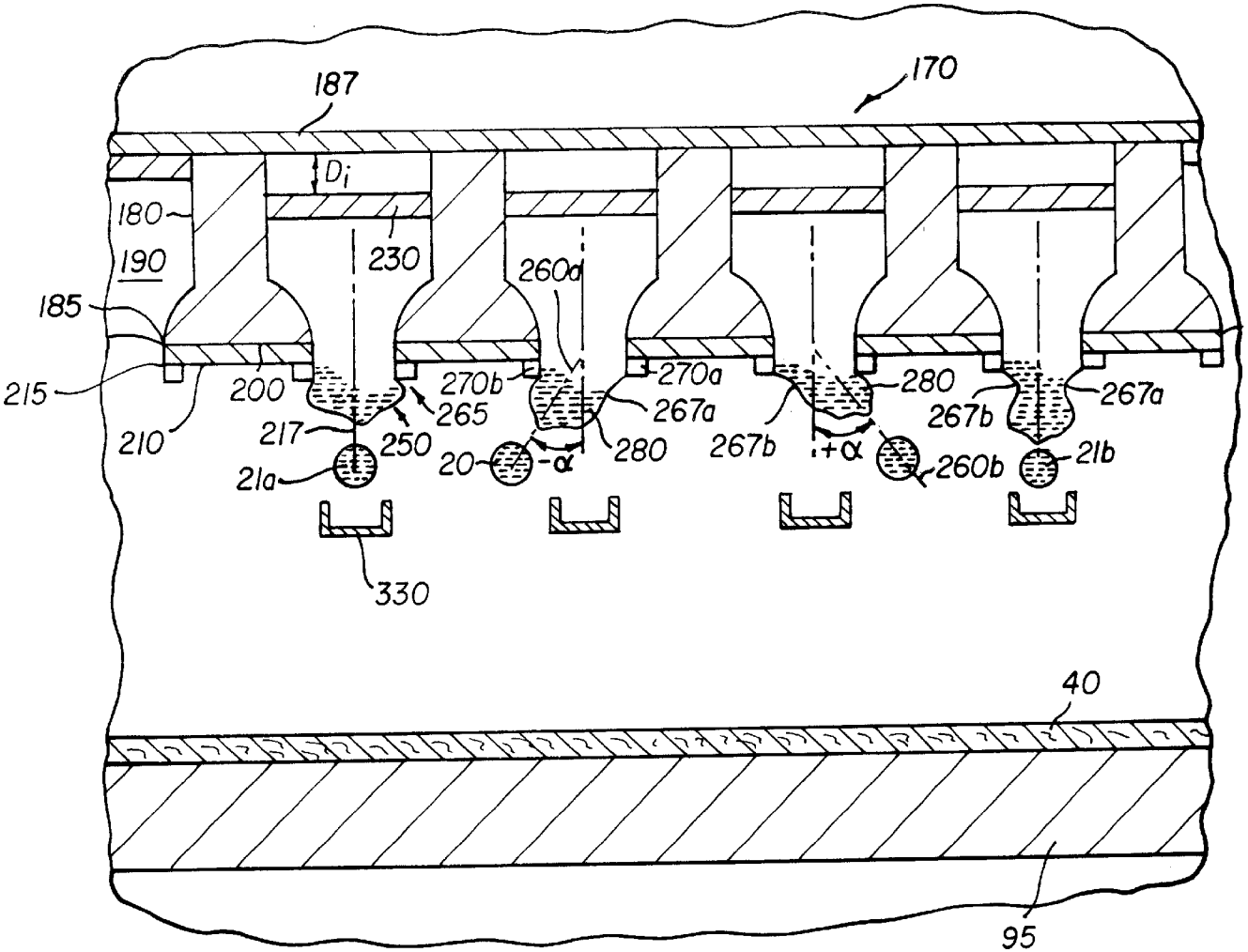
FIG. 15 is a fragmentation view in vertical section of a fifth embodiment of the printer, wherein there is disposed a gutter opposite each orifice.

Referring to FIG. 15, there is shown a fifth embodiment of the present invention, wherein ink droplets 21*a*/*b* that are not intended to produce an ink mark on receiver 40 are instead directed into an ink recycling gutter 330 connected to ink reservoir 140, so that unused ink droplets 21*a*/*b* are returned to reservoir 140 and recycled. Ink droplets 20 intended to produce ink marks are deflected onto receiver 40 in the manner described hereinabove.

Figure 16:
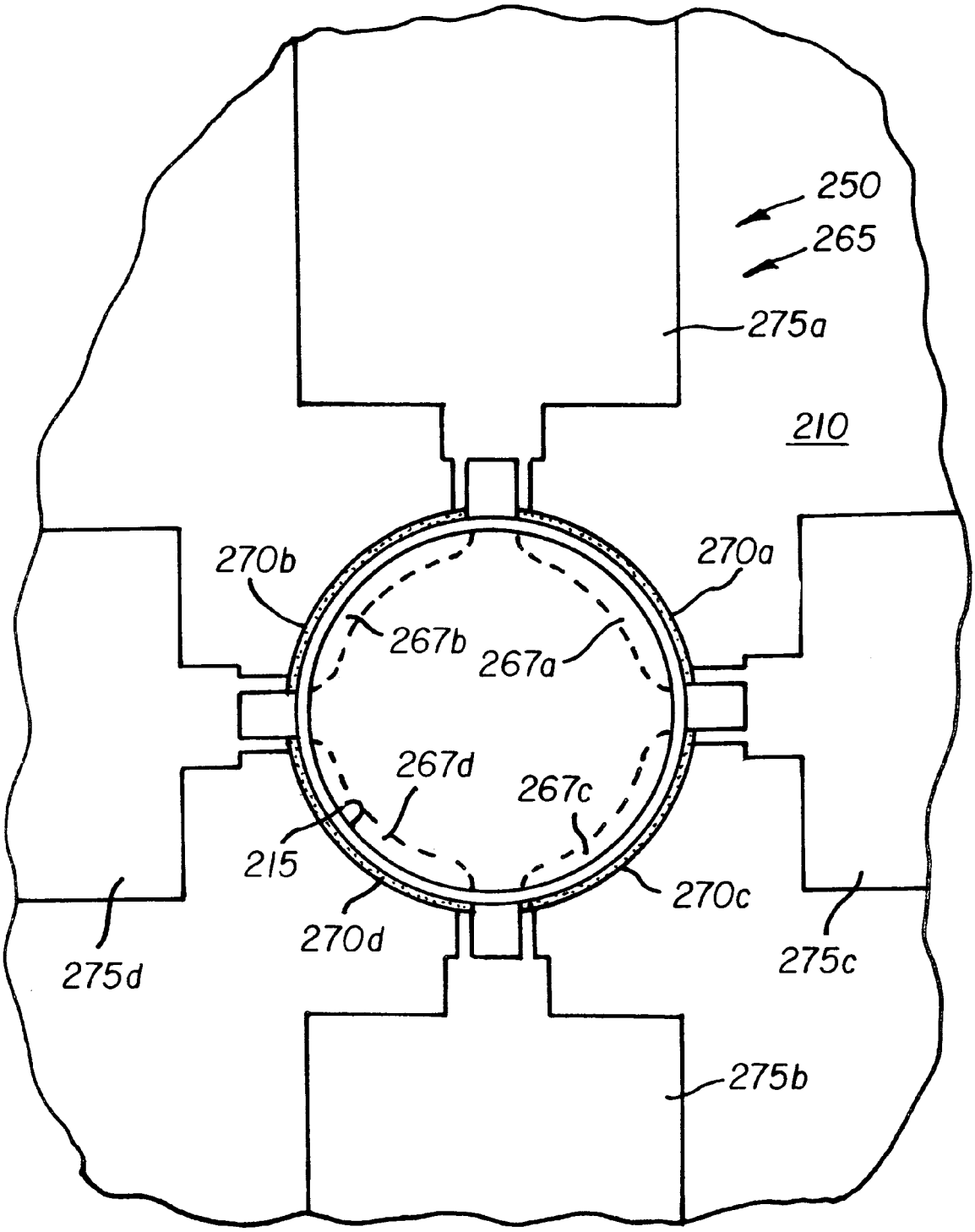
FIG. 16 is a fragmentation view in vertical section of a sixth embodiment of the printer, wherein each heater assembly has four heater segments.

Referring to FIG. 16, there is shown a sixth embodiment of the present invention, wherein deflector 250 comprises four heater segments 270*a*/*b*/*c*/*d* mounted on orifice plate 210 and adjacent to each orifice 215 for deflecting ink drop 20 away from center axis 217 along any of four separate angles. Each of heater segments 270*a*/*b*/*c*/*d* is adapted to be in heat transfer communication with poised meniscus 240 for lowering surface tension of any of side regions 267*a*/*b*/*c*/*d* (dotted line in FIG. 16) of poised meniscus 240. Each heater segment 270*a*/*b*/*c*/*d* is connected to heater control circuit 160 by means of electrical contacts 275*a*/*b*/*c*/*d*, respectively. In this manner, heater control circuit 160 controllably and selectively supplies electrical current to any of heater segments 270*a*/*b*/*c*/*d* for reasons disclosed presently. In this regard, use of four heater segments 270*a*/*b*/*c*/*d* allows deflected meniscus 280 to assume a greater number of possible orientations for increased accuracy of ink droplet placement on receiver 40. However, it should be appreciated that heater control circuit 160 is capable of controllably supplying electrical current to heater segment 27*a*/*b*/*c*/*d* simultaneously for allowing droplet 21*a*/*b* to travel along center axis 217, if desired.

Figure 17:
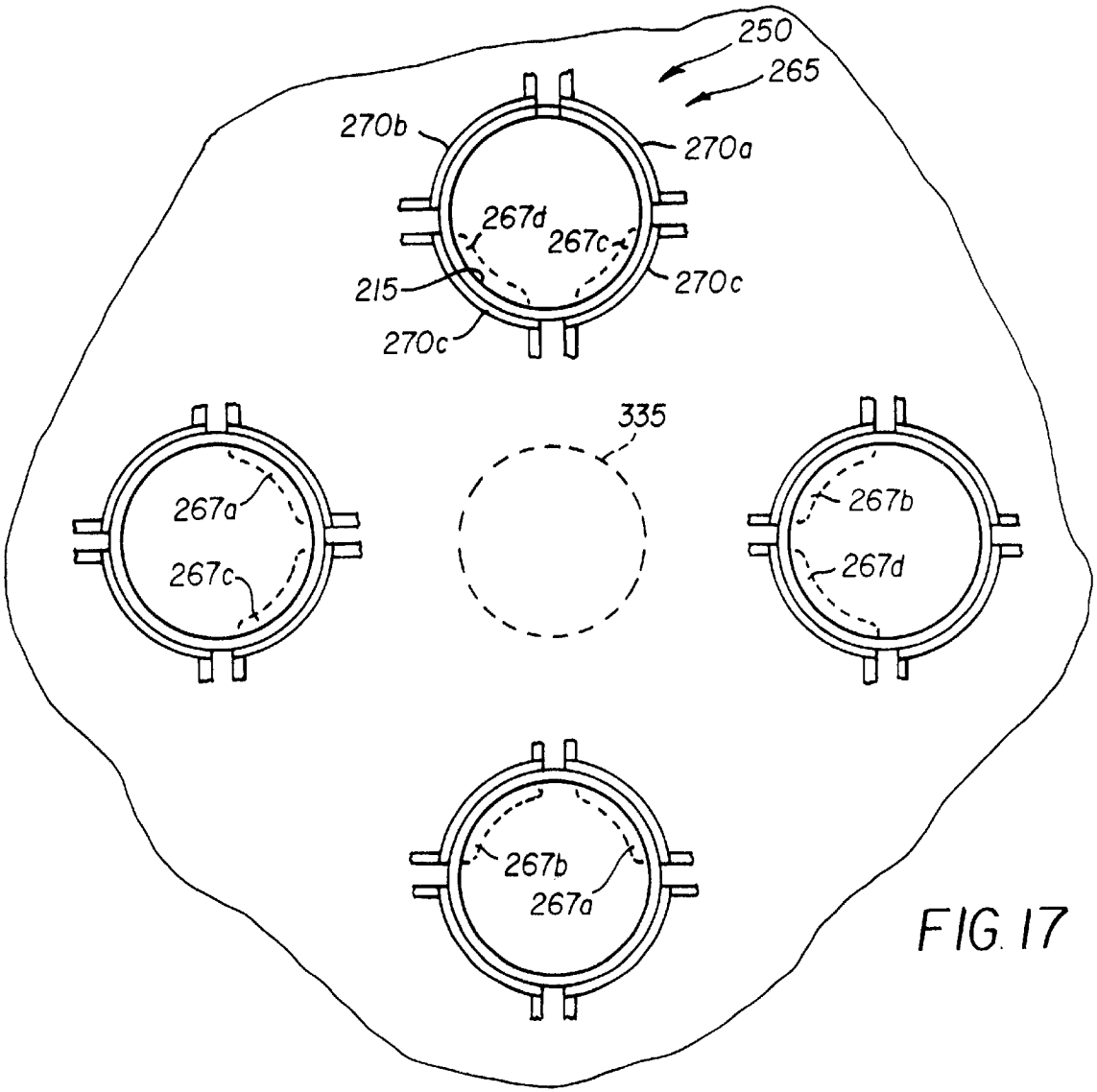
FIG. 17 is a fragmentation view in vertical section of a seventh embodiment of the printer, wherein there is shown, with parts removed for clarity, a plurality of the heater elements arranged so as to print a single ink mark equidistant therebetween.

Referring to FIG. 17, there is shown a seventh embodiment of the present invention, comprising a plurality of heater assemblies 265 arranged so as to produce a single ink mark 335 (dotted circle in FIG. 17) equidistant therebetween. It may be understood that, because each heater assembly 265 and each heater segment 270*a*/*b*/*c*/*d* therein is individually controllable by heater control circuit 160, ink mark 335 may obtain a multiplicity of print tone levels for more accurate reproduction of image data provided by image source 50.

An advantage of the present invention is that, if any one of the ejection orifices 215 is inoperable, such as due to clogging or manufacturing defect, ink drops 20 are redirected from an operable orifice to print at locations that would otherwise be printed by the inoperable orifice. This is so because the meniscus poised at the ink ejection orifice is deflected in a predetermined direction so that the ink drop travels in that direction.

Another advantage of the present invention is that use thereof reduces print head manufacturing costs. This is so because each orifice 215 can print ink marks at a plurality of locations on receiver 40 thereby reducing the number of orifices needed.

Yet another advantage of the present invention is that printing speed is variable depending on the particular needs of the print job. This is so because velocity at which the ink drops strike the recording medium is controlled by amount of displacement of the pressurizer that moves in ink channel 180.

The invention has been described in detail with particular reference to certain preferred embodiments thereof, but it should be understood that variations and modifications can be effected within the spirit and scope of the invention. For example, although the invention is disclosed with respect to use in a DOD ink jet printer, the invention is also usable in a "continuous" ink jet printer, as well.

Therefore, what is provided is a drop-on-demand ink jet printer capable of directional control of ink drop ejection and method of assembling the printer.

PARTS LIST $V_i$ . . . voltage amplitude
$W_i$ . . . pulse width
10 . . . DOD ink jet printer
20 . . . ink drop
30 . . . print head
40 . . . receiver
50 . . . image source
60 . . . image processor
70 . . . half-toning unit
80 . . . image memory
90 . . . waveform generator
95 . . . platen
100 . . . transport rollers
110 . . . transport controller
120 . . . controller
130 . . . ink pressure regulator
140 . . . ink reservoir
150 . . . conduit
160 . . . heater control circuit
170 . . . print head body
180 . . . ink channel
185 . . . ink channel outlet
187 . . . backing plate
190 . . . ink body
200 . . . surface (on print head body)
210 . . . orifice plate
215 . . . orifice
217 . . . center axis
220 . . . ink drop separator
230 . . . piezoelectric transducer
235 . . . electrical pulse
240 . . . poised meniscus
250 . . . deflector
260 . . . deflected trajectory
265 . . . heater assembly
267*a*/*b*/*c*/*d* . . . heated side regions (of meniscus)
270*a*/*b*/*c*/*d* . . . heater segments
275*a*/*b*/*c*/*d* . . . electrical contacts
280 . . . deflected meniscus
290 . . . piston
295 . . . seal
297 . . . piston rod
300 . . . plate member
310*a*/*b* . . . electromagnets
320 . . . elastomeric membrane
325 . . . pressurizer/depressurizer unit
327 . . . control valve
330 . . . ink recycling gutter
335 . . . single ink mark

What is claimed is:

1. A drop-on-demand ink jet printer capable of directional control of ink drop ejection for selective placement upon a receiver, comprising:

(a) a print bead body having an ink ejection orifice adapted to poise an ink meniscus thereat about a center axis passing through the orifice;

(b) a deflector coupled to said print head body and adapted to be in communication with the poised meniscus for lowering surface tension of a region of the poised meniscus, so that the poised meniscus deflects away from the region of lower surface tension and away from the center axis to define a deflected meniscus, whereby an ink drop separated from the deflected meniscus travels at an angle with respect to the center axis and deposits upon the receiver, and drop separator separates the ink drop at a predetermined velocity.

2. The printer of claim 1, wherein said deflector comprises a heater assembly.

3. The printer of claim 2, wherein said heater assembly comprises a plurality of heater segments disposed adjacent to the orifice.

4. The printer of claim 1, further comprising an ink drop separator coupled to said print head body for forming the poised meniscus at the orifice and thereafter for separating the ink drop from the deflected meniscus.

5. The printer of claim 4, wherein said ink drop separator is adapted to pressurize said print head body.

6. The printer of claim 4, wherein said ink drop separator separates the ink drop at a predetermined velocity.

7. A drop-on-demand ink jet printer capable of directional control of ink drop ejection for selectively depositing ink drops upon a receiver, comprising:

(a) a print head body having a plurality of ink channels therein each terminating in an ink ejection orifice adapted to poise an ink meniscus thereat symmetrically about a center axis normal to the orifice;

(b) a heater assembly connected to said print head body and adapted to be in heat transfer communication with the poised meniscus for lowering surface tension of a side region of the poised meniscus, so that the poised meniscus laterally deflects away from the side region of lower surface tension and away from the center axis to define a deflected meniscus, and so that an ink drop separated from the deflected meniscus travels along a trajectory at a predetermined variable angle with respect to the center axis and deposits upon the receiver, (c) a pressurizer connected to said print head body and in communication with each of the channels for pressurizing the channels to form the poised menisci and thereafter to separate the ink drop from the deflected meniscus, and (d) wherein said printer is a gutterless printer.

8. The printer of claim 7, wherein said heater assembly comprises a plurality of heater segments symmetrically arranged around each orifice.

9. The printer of claim 7, wherein said pressurizer comprises:

(a) a plurality of deflectable piezoelectric transducers in communication with respective ones of the plurality of channels, said piezoelectric transducers adapted to deflect into the channels while electrically stimulated for reducing volume of the channels so that the channels pressurize; and (b) a waveform generator connected to each of said piezoelectric transducers for electrically stimulating said piezoelectric transducers for deflecting said piezoelectric transducers into the channels.

10. The printer of claim 7, wherein said pressurizer comprises:

(a) a plurality of displaceable flexible membranes in communication with respective ones of the plurality of channels, said flexible membranes adapted to flex into the channels while pressurized for reducing volume of the channels so that the channels pressurize; and (b) a pressurizer/depressurizer unit in communication with each of said flexible membranes for pressurizing said elastic membranes in order to flex said flexible membranes into the channels.

11. The printer of claim 7, wherein said pressurizer comprises:

(a) a plurality of displaceable pistons in communication with respective ones of the plurality of channels, said pistons adapted to move in the channels while pressurized for reducing volume of the channels so that the channels pressurize; and (b) a piston rod connected to each of said pistons for moving said pistons in the channels.

12. The printer of claim 7, wherein said pressurizer comprises:

(a) a plurality of plate members in communication with respective ones of the plurality of channels, said plate members adapted to move in the channels for reducing volume of the channels so that the channels pressurize; and (b) a pair of electromagnets disposed adjacent to each plate member for moving each of said plate members in the channels.

13. The printer of claim 7, further comprising a plurality of recycling gutters disposed opposite respective ones of the orifices for recycling the ink drop separated from an undeflected meniscus.

14. The printer of claim 7, further comprising a plurality of heater assemblies arranged so as to print a single ink mark equidistant therebetween.

15. The printer of claim 7, wherein said pressurizer separates the ink drop at a predetermined velocity.

16. A drop-on-demand ink jet printer capable of directional control of ink drop ejection for selectively depositing ink drops upon a receiver, comprising:

(a) a print head body having a plurality of elongate ink channels therein each terminating in a generally circular ink section orifice adapted to poise an ink meniscus thereat symmetrically about a center axis normal to the orifice;

(b) a plurality of arcuate-shaped heater segments connected to said print head body and symmetrically arranged in an annular ring surrounding each orifice, said heater segments adapted to be in heat transfer communication with the poised meniscus and energized for lowering surface tension of a predetermined side region of the poised meniscus while a selected one of heater segments is energized so that the poised meniscus lately deflects away from the side region of lower surface tension and away from the center as to define a deflected meniscus, and so that an ink drop separated from the deflected meniscus travels along a trajectory at a predetermined variable angle with respect to the center axis and deposits upon the receiver, (c) a pressurizer connected to said print head body and in communication with each of the channels for pressurizing the channels to form the poised meniscus and thereafter to separate the ink drop from the deflected meniscus, and (d) wherein said printer is a gutterless printer.

17. The printer of claim 16, wherein said pressurizer comprises:

(a) a plurality of deflectable piezoelectric transducers in communication with respective ones of the plurality of channels, said piezoelectric transducers adapted to deflect into the channels while electrically stimulated for reducing volume of the channels so that the channels pressurize; and (b) a waveform generator connected to each of said piezoelectric transducers for electrically stimulating said piezoelectric transducers for deflecting said piezoelectric transducers into the channels.

18. The printer of claim 16, wherein said pressurizer comprises:

(a) a plurality of displaceable flexible membranes in communication with respective ones of the plurality of channels, said flexible membranes adapted to flex into the channels while pressurized for reducing volume of the channels so that the channels pressurize; and (b) a pressurizer/depressurizer unit in communication with each of said flexible membranes for pressurizing said elastic membranes in order to flex said flexible membranes into the channels.

19. The printer of claim 16, wherein said pressurizer comprises:

(a) a plurality of displaceable pistons in communication with respective ones of the plurality of channels, said pistons adapted to move in the channels while pressurized for reducing volume of the channels so that the channels pressurize; and (b) a piston rod connected to each of said pistons for moving said pistons the channels.

20. The printer of claim 16, wherein said pressurizer comprises:

(a) a plurality of plate members in communication with respective ones of the plurality of channels, said plate members adapted to move in the channels for reducing volume of the channels so that the channels pressurize; and (b) a pair of electromagnets disposed adjacent to each plate member for moving each of said plate members in the channels.

21. The printer of claim 16, further comprising a plurality of recycling gutters disposed opposite respective ones of the orifices for recycling the ink drop separated from an undeflected meniscus.

22. The printer of claim 16, further comprising a plurality of heater assemblies arranged so as to print a single ink mark equidistant therebetween.

23. The printer of claim 16, wherein said pressurizer separates the ink drop at a predetermined velocity.

24. A method of operating a drop-on-demand ink jet printer capable of directional control of ink drop ejection for selectively depositing ink drops upon a receiver, comprising the steps of:

(a) providing a print head body having a ink election orifice adapted to poise an ink meniscus thereat about a center axis passing through the orifice; and (b) activating a deflector, the deflector being in communication with the poised meniscus and lowering surface tension of a region of the poised meniscus, so that the poised meniscus deflects away from the region of lower surface tension and away from the center axis to define a deflected meniscus, whereby an ink drop separated from the deflected meniscus travels at an angle with respect to the center axis and deposits upon the receiver and the printer is gutterless so that no ink drop deposits in a gutter.

25. The method of claim 24, wherein the step of activating a deflector comprises the step of activating a heater assembly to produce heat.

26. The method of claim 25, wherein the step of activating a heater assembly comprises the step of activating a plurality of heater segments adjacent to the orifice.

27. The method of claim 24, wherein an ink drop separator cooperates with the print head body for forming the poised meniscus at the orifice prior to the ink drop separating from the deflected meniscus.

28. The method of claim 27, wherein the ink drop separator pressurizes the ink in the print head body.

29. The method of claim 27, wherein the ink drop separator separates the ink drop at a predetermined velocity.

30. A method of assembling a drop-on-demand ink jet printer capable of directional control of ink drop ejection for selectively depositing ink drops upon a receiver, comprising the steps of:

(a) providing a print head body having a plurality of ink channels therein each terminating in an ink ejection orifice adapted to poise an ink meniscus thereat symmetrically about a center axis normal to the orifice;

(b) connecting a heater assembly to the print head body, the heater assembly being adapted to be in heat transfer communication with the poised meniscus for lowering surface tension of a side region of the poised meniscus, so that the poised meniscus laterally deflects away from the side region of lower surface tension and away from the center axis to define a deflected meniscus, and so that an ink drop separated from the deflected meniscus travels along a trajectory at a predetermined variable angle with respect to the center axis and deposits upon the receiver and the printer is gutterless so that no ink drop deposits in a gutter; and (c) connecting a pressurizer to the print head body, the pressurizer being in communication with each of the channels for pressurizing the channels to form the poised menisci and thereafter to separate the ink drop from the deflected meniscus.

31. The method of claim 30, wherein the step of connecting a heater assembly comprises the step of connecting a plurality of heater segments symmetrically arranged around each orifice.

32. The method of claim 30, wherein the step of connecting a pressurizer comprises the steps of:

(a) providing a plurality of deflectable piezoelectric transducers in communication with respective ones of the plurality of channels, the piezoelectric transducers adapted to deflect into the channels while electrically stimulated for reducing volume of the channels so that the channels pressurize; and (b) connecting a waveform generator to each of the piezoelectric transducers for electrically stimulating the piezoelectric transducers for deflecting the piezoelectric transducers into the channels.

33. The method of claim 30, wherein the pressurizer comprises:

(a) a plurality of displaceable flexible membranes in communication with respective ones of the plurality of channels, the flexible membranes adapted to flex into the channels while pressurized for reducing volume of the channels so that the channels pressurize; and (b) a pressurizer/depressurizer unit in communication with each of the flexible membranes for pressurizing the elastic membranes in order to flex the flexible membranes into the channels.

34. The method of claim 30, wherein the step of connecting a pressurizer comprises the steps of:

(a) disposing a plurality of displaceable pistons in communication with respective ones of the plurality of channels, the pistons adapted to move in the channels while pressurized for reducing volume of the channels so that the channels pressurize; and (b) connecting a piston rod to each of the pistons for moving the pistons in the channels.

35. The method of claim 30, wherein the step of connecting a pressurizer comprises the steps of:

(a) disposing a plurality of plate members in communication with respective ones of the plurality of channels, the plate members adapted to move in the channels for reducing volume of the channels so that the channels pressurize; and (b) disposing a pair of electromagnets adjacent to each plate member for moving each of the plate members in the channels.

36. The method of claim 30, further comprising the step of disposing a plurality of recycling gutters opposite respective ones of the orifices for recycling the ink drop separated from an undeflected meniscus.

37. The method of claim 30, further comprising the step of arranging a plurality of heater assemblies so as to print a single ink mark equidistant therebetween.

38. The method of claim 30, wherein the step of connecting a pressurizer comprises the step of connecting a pressurizer that separates the ink drop at a predetermined velocity.

39. A method of operating a drop-on-demand ink jet printer capable of directional control of ink drop ejection for selectively depositing ink drops upon a receiver, comprising the steps of:

(a) providing a print head body having a plurality of elongate ink channels therein each terminating in a generally circular ink ejection orifice adapted to poise an ink meniscus thereat symmetrically about a center axis normal to the orifice;

(b) providing a plurality of arcuate-shaped heater segments, the heater segments being symmetrically arranged in an annular ring surrounding each orifice, and selectively energizing one of heater segments to lower surface tension of a predetermined side region of the poised meniscus, so that the poised meniscus laterally deflects away from the side region of lower surface tension and away from the center axis to define a deflected meniscus, and so that an ink drop separated from the deflected meniscus travels along a trajectory at a predetermined variable angle with respect to the center axis and deposits upon the receiver and the printer is gutterless so that no ink drop deposits in a gutter; and (c) operating a pressurizer that is in communication with each of the channels and pressurizing the channels to form the poised meniscus and thereafter to separate the ink drop from the deflected meniscus.

40. The method of claim 39, wherein the pressurizer comprises:

(a) a plurality of deflectable piezoelectric transducers in communication with respective ones of the plurality of channels, the piezoelectric transducers operating to deflect into the channels while electrically stimulated for reducing volume of the channels so that the channels pressurize; and (b) a waveform generator connected to each of the piezoelectric transducers that electrically stimulates the piezoelectric transducers for deflecting the piezoelectric transducers into the channels.

41. The method of claim 39, wherein the step of operating the pressurizer comprises the steps of:

(a) activating a plurality of displaceable flexible membranes in communication with respective ones of the plurality of channels, the flexible membranes flexing into the channels while pressurized for reducing volume of the channels so that the channels pressurize; and (b) wherein a pressurizer/depressurizer unit in communication with each of the flexible membranes pressurizing the elastic membranes in order to flex the flexible membranes into the channels.

42. The method of claim 39, wherein the pressurizer comprises:

(a) a plurality of displaceable pistons in communication with respective ones of the plurality of channels, the pistons moving in the channels while pressurized to reduce volume of the channels so that the channels pressurize; and (b) a piston rod connected to each of the pistons for moving the pistons into the channels.

43. The method of claim 39, wherein the pressurizer comprises:

(a) a plurality of plate members in communication with respective ones of the plurality of channels, the plate members moving in the channels for reducing volume of the channels so that the channels pressurize; and (b) a pair of electromagnets adjacent to each plate member for moving each of the plate members in the channels.

44. The method of claim 39, further comprising the step of disposing a plurality of recycling gutters opposite respective ones of the orifices for recycling the ink drop separated from an undeflected meniscus.

45. The method of claim 39, further comprising the step of arranging a plurality of heater assemblies so as to print a single ink mark equidistant therebetween.

46. The method of claim 39, wherein the step of operating a pressurizer comprises the step of operating a pressurizer that separates the ink drop at a predetermined velocity.

* * * * *